US009609924B1

(12) United States Patent
Silverman

(10) Patent No.: US 9,609,924 B1
(45) Date of Patent: Apr. 4, 2017

(54) BENDABLE JEWELRY

(71) Applicant: Shoe Jewelry, LLC, Naples, FL (US)

(72) Inventor: Christina Silverman, Naples, FL (US)

(73) Assignee: Show Jewelry, LLC, Naples, FL (US)

( * ) Notice: Subject to any disclaimer, the term of this patent is extended or adjusted under 35 U.S.C. 154(b) by 0 days.

(21) Appl. No.: 15/130,543

(22) Filed: Apr. 15, 2016

(51) Int. Cl.

| | |
|---|---|
| ***A43B 23/00*** | (2006.01) |
| ***A43B 23/24*** | (2006.01) |
| ***A44C 25/00*** | (2006.01) |
| ***A41D 27/08*** | (2006.01) |
| *A43B 3/00* | (2006.01) |

(52) U.S. Cl.
CPC ..... *A44C 25/00* (2013.01); *A41D 27/08* (2013.01); *A43B 23/24* (2013.01); *A43B 3/0078* (2013.01)

(58) Field of Classification Search
CPC ..... A43B 23/24; A43B 23/30; A43B 3/0078; A44C 25/00; A44C 25/008; A44C 5/0076; A44C 5/0061; A44C 5/0007; A41D 27/08
USPC ..... 36/136, 132, 100; D11/200; 63/3.1, 3, 63/5.1; D2/896, 946, 976, 978
See application file for complete search history.

(56) References Cited

U.S. PATENT DOCUMENTS

| | | | | | |
|---|---|---|---|---|---|
| 240,096 | A * | 4/1881 | Crane | A44C 5/0092 | 63/11 |
| 749,587 | A * | 1/1904 | Simon | A44C 5/0092 | 63/11 |
| 1,514,706 | A * | 11/1924 | Kennedy | A43B 3/0078 | 36/1 |
| 1,549,267 | A * | 8/1925 | Kennedy | A43B 3/0078 | 36/1 |
| 2,266,942 | A * | 12/1941 | Wallace | A44C 5/0046 | 401/131 |
| 2,461,977 | A * | 2/1949 | Gilmour | A43B 3/0078 | 24/507 |
| 4,026,047 | A * | 5/1977 | Ahmer | A43B 23/24 | 2/245 |
| 4,333,248 | A * | 6/1982 | Samuels | A43B 3/18 | 36/101 |
| 4,724,628 | A | 2/1988 | Schreiner | | |
| 5,649,376 | A * | 7/1997 | Lecates, Jr. | A43B 3/0005 | 36/137 |
| 6,276,029 | B1 * | 8/2001 | Buettell | A44C 5/0007 | 24/16 PB |
| D659,376 | S | 5/2012 | John | | |
| 8,544,196 | B2 | 10/2013 | Leo | | |
| 2005/0166636 | A1 * | 8/2005 | Lazor | A44C 5/0007 | 63/38 |
| 2010/0047604 | A1 * | 2/2010 | Stratton-Metzger | A43B 1/0027 | 428/542.2 |
| 2010/0307031 | A1 | 12/2010 | Granito | | |
| 2012/0073165 | A1 | 3/2012 | McKeown | | |
| 2012/0214380 | A1 * | 8/2012 | Vine, III | A44C 5/0084 | 446/121 |

* cited by examiner

*Primary Examiner* — Jila M Mohandesi
(74) *Attorney, Agent, or Firm* — David L. King

(57) ABSTRACT

A bendable jewelry device in the form of an elongated structure has a first end and one or more elongated bodies. At least one of the one or more elongated bodies has a length extending from the first end to a second end of the body. The body is bendable along the length to wrap about a portion of an article of clothing. The first end portion has a means for attaching the first end to a portion of the article of clothing. The means for attachment is secured to the first end.

13 Claims, 15 Drawing Sheets

BENDABLE JEWELRY

TECHNICAL FIELD

The present invention relates to an elongated jewelry device for attachment to an article of clothing such as footwear, garments or accessories like a purse. The jewelry device preferably is bendable to wrap about a portion of the article of clothing.

BACKGROUND OF THE INVENTION

Jewelry has been fashioned since time immemorial for wearing around the neck, wrist and ankles of an individual and oftentimes the jewelry is attached to an article of clothing, such as a garment, a dress, a jacket or other article of clothing. Historically, the adornment of jewelry on articles of clothing such as shoes has been difficult. Attachment of such jewelry had to either be permanently affixed to the footwear or alternatively, had to be positioned in such a way that, if removable from the footwear, would leave a pierced mark or other damage to the shoe structure, as such, people have generally avoided the use of jewelry on shoes that is not formed as part of the shoe and permanently attached.

The present invention provides a unique way of providing a securely attached elongated piece of jewelry to either a strap on a purse or garment or a portion of footwear in such a way that it can be attached and removed without damage to the article of clothing, as is described hereinafter.

SUMMARY OF THE INVENTION

A bendable jewelry device in the form of an elongated structure has a first end and one or more elongated bodies. At least one of the one or more elongated bodies has a length extending from the first end to a second end of the body. The body is bendable along the length to wrap about a portion of an article of clothing. The first end portion has a means for attaching the first end to a portion of the article of clothing. The means for attachment is secured to the first end.

The means for attachment can be one or more pins. The one or more pins is preferably secured to the first end on an inclined angle relative to a surface of the first end from which the pin projects from. The inclined angle is less than 45 degrees from the surface of the first end, preferably the inclined angle is about 30 degrees. Also, the one or more pins can be a bent form with a hooked end having the end directionally extending toward a portion of the elongated body. Alternatively, the means for attachment can be a hinged pin wherein the hinged pin is configured to fold and the first end has a recessed cavity to receive the hinged pin. The attachment means is configured to penetrate into a stitched seam of a shoe and stitches of the shoe seam hold the first end or a strap of an article of clothing. The first end, when held at the seam, is fixed in place by a bending of the elongated body being wrapped about a portion of the shoe or strap of the article of clothing. The bendable jewelry device wherein the portion of the article of clothing is a heel of a shoe of a height sufficient to wrap the elongated body at least 180 degrees about the heel or a garment or purse strap of a sufficient length. The elongated body wraps spirally about the heel or strap forming at least one coil.

The bendable jewelry device has the elongated structure made of a bendable material that retains the bent shape after bending. The bendable material can be a soft metal alloy, a moldable plastic or moldable plastic with wire reinforcement to retain bended shapes. The bendable jewelry can be designed with the elongated structure in the form of a reptile, preferably a snake with a head at the first end and tail at the second end. Alternatively, the elongated structure can be in the form of a zipper or a bow, the bow having two elongated ribbons extending to form the elongated body. All embodiments can be easily removed when unwrapped from the heel or strap.

BRIEF DESCRIPTION OF THE DRAWINGS

The invention will be described by way of example and with reference to the accompanying drawings in which.

DETAILED DESCRIPTION OF THE INVENTION

Figure 14A:
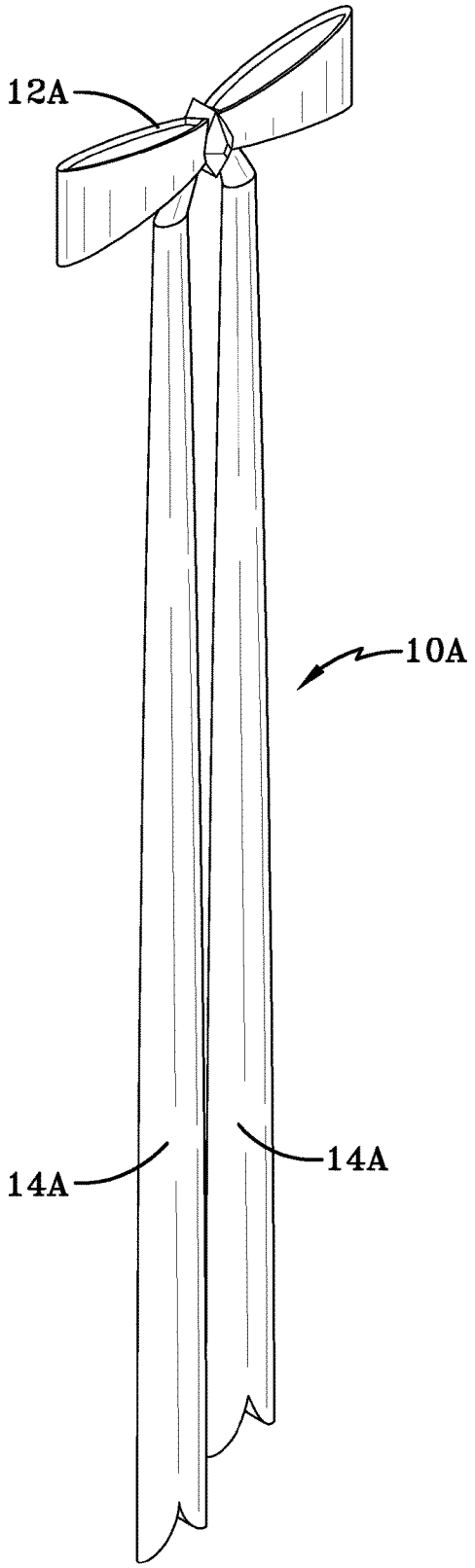
FIG. 14A is a frontal side perspective view of a second alternative embodiment of the present invention.
Figure 14B:
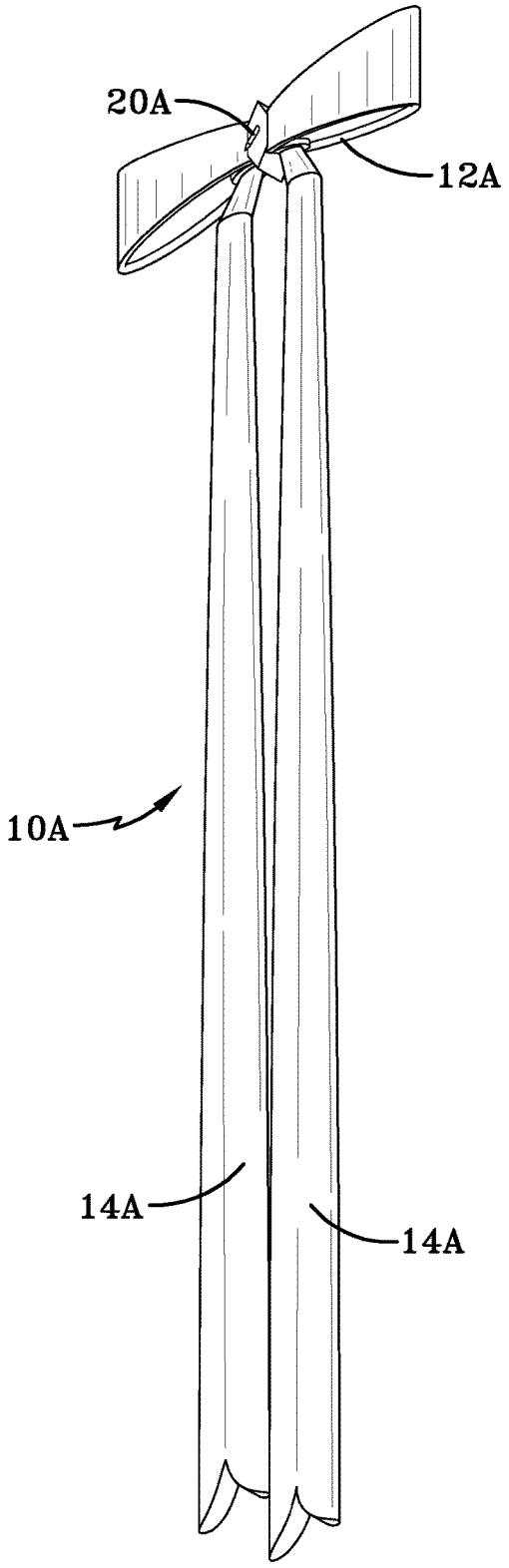
FIG. 14B is a second side perspective view of the second embodiment of FIG. 14A.
Figure 14C:
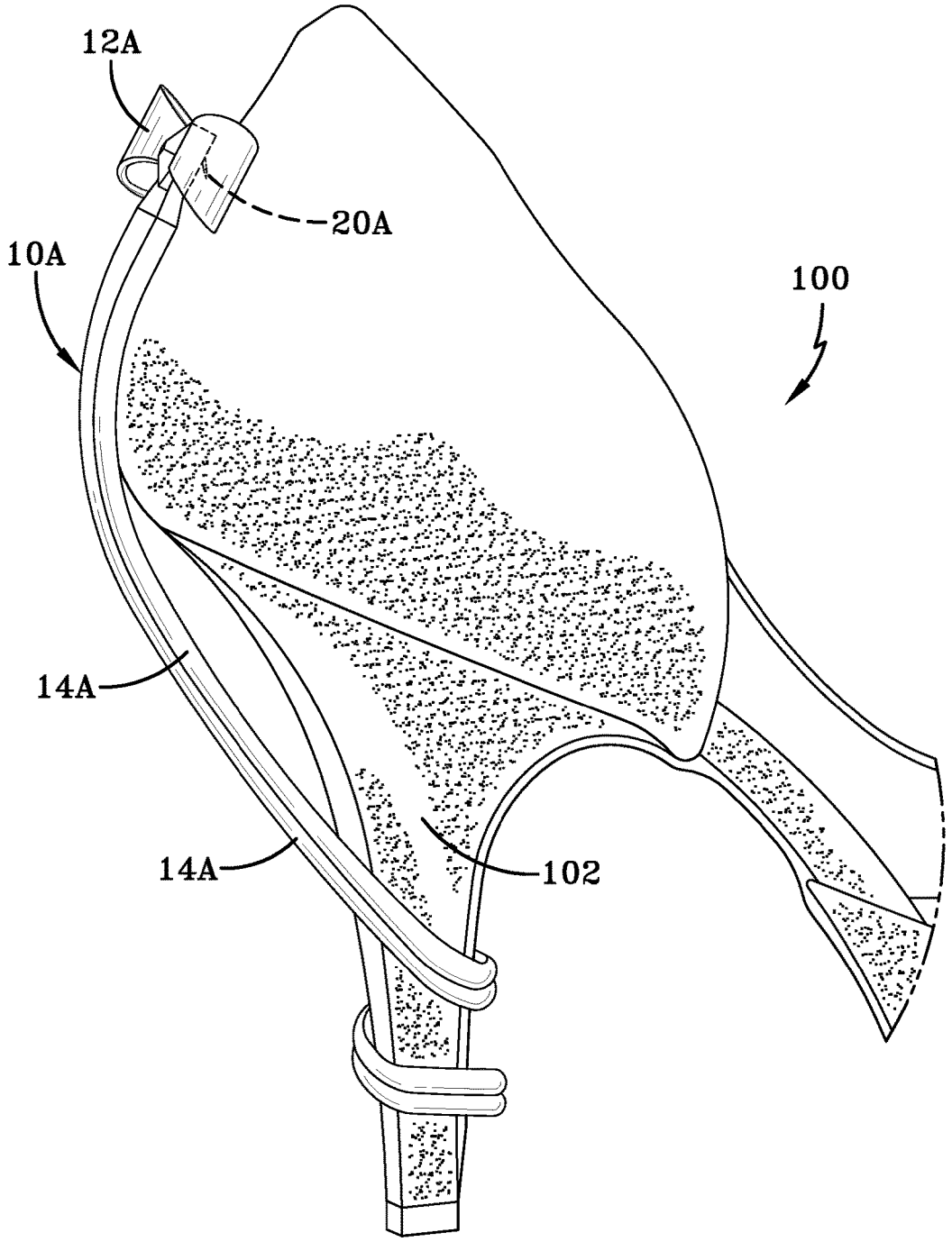
FIG. 14C is a view showing the second embodiment attached to the rear portion of an exemplary shoe and wrapped about a heel.
Figure 15A:
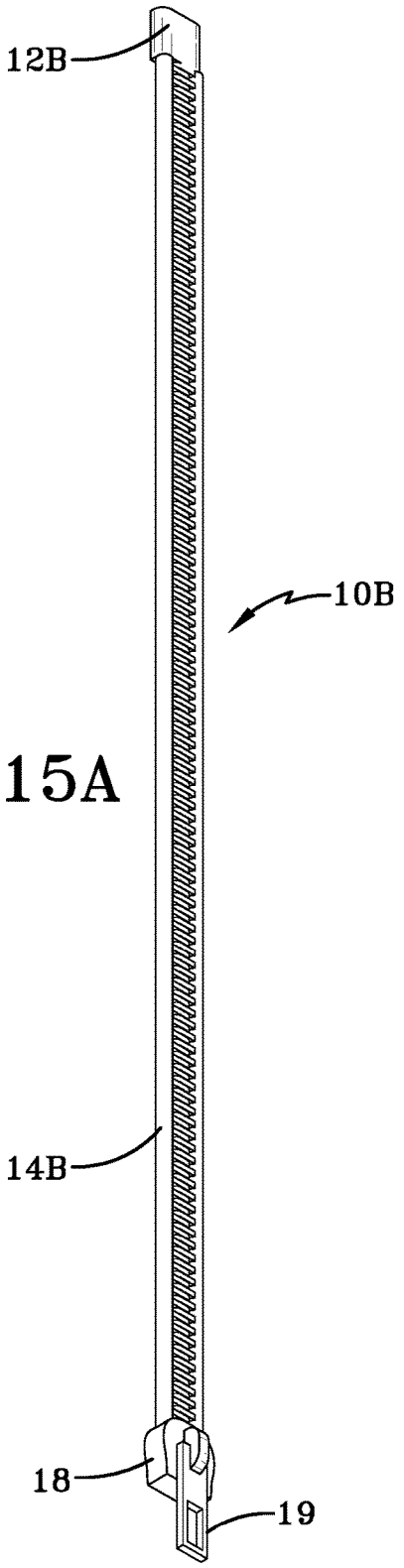
FIG. 15A is a frontal side perspective view of a third alternative embodiment of the present invention.
Figure 15B:
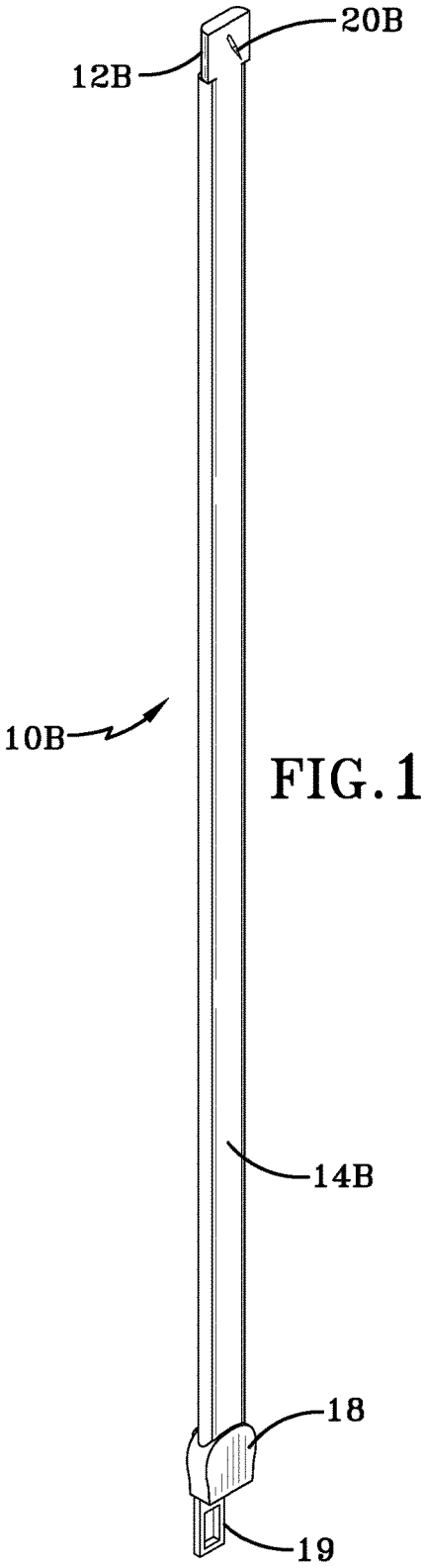
FIG. 15B is a second side perspective view of the third embodiment of FIG. 15A.
Figure 15C:
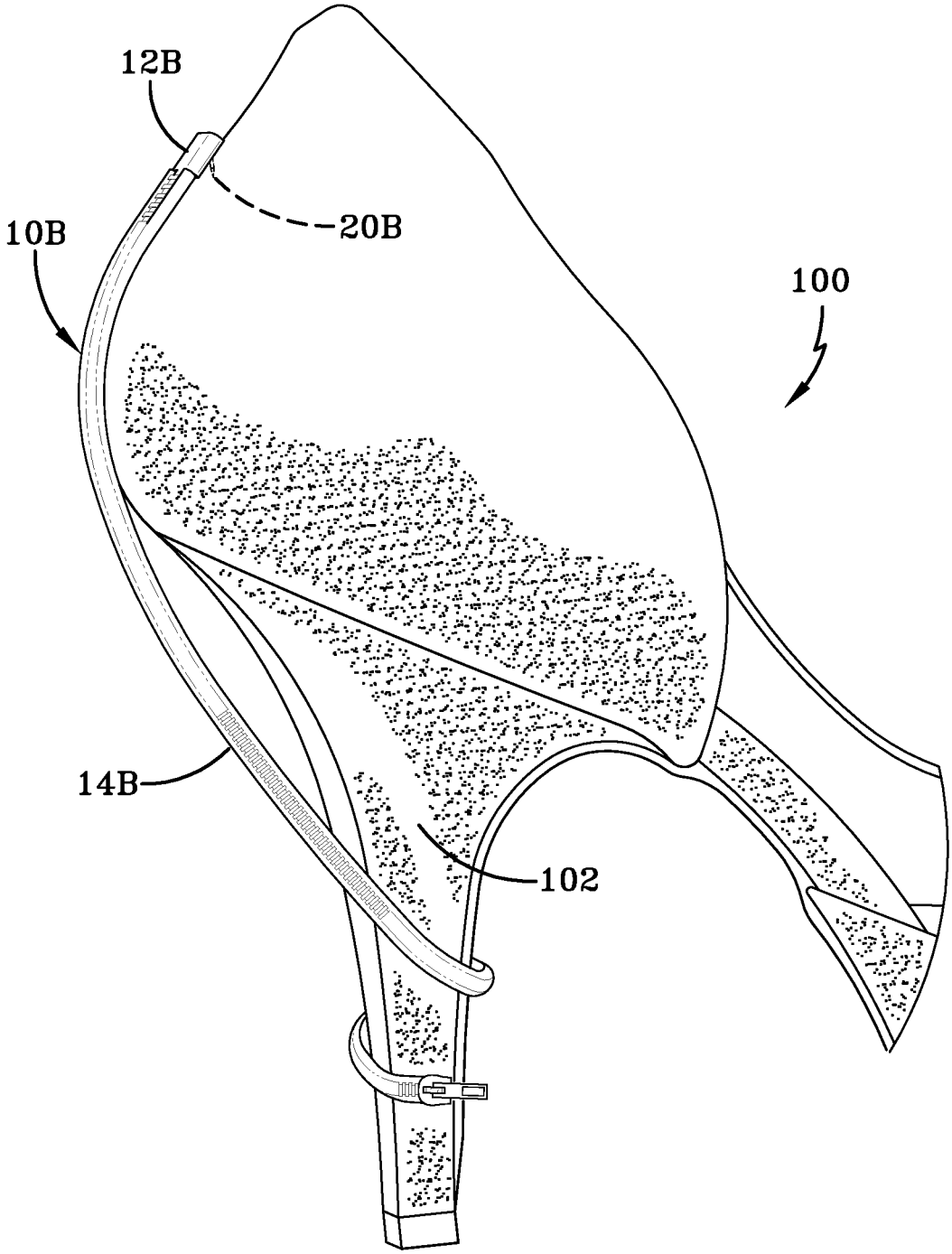
FIG. 15C is a view showing the third embodiment attached to the rear portion of an exemplary shoe and wrapped about a heel.

With reference to FIGS. 1-13D, represent a first embodiment of the present invention. FIGS. 14A-14C represent a second alternative embodiment of the present invention. FIGS. 15A-15C represent a third alternative embodiment of the present invention.

As shown, the first embodiment of the invention is illustrated representing the design features of a reptile, more particularly a snake. The second embodiment of the invention illustrated in FIGS. 14A-C illustrates a bow with two elongated ribbons or strands extending from the knotted bow. The third embodiment of the invention illustrates a zipper. The zipper having a first end with an attachment means illustrated and the opposing opposite end mimicking a zipper clasp and tongue for opening and closing device for the zipper. As discussed hereinafter the features of the first embodiment can apply equally well to the second and third embodiments as it relates to the attachment means and the basic overall structure of the design.

As shown in each embodiment a bendable jewelry device 10, 10A, 10B in the form of an elongated structure has a first end 12 and one or more elongated bodies 14, 14A, 14B. At least one of the one or more elongated bodies has a length extending from the first end 12 to a second end 15 of the body 14, 14A, 14B. The body 14, 14A, 14B is bendable along the length to wrap about a portion of an article of clothing. The first end 12 has a means 20 for attaching the first end 12 to a portion of the article of clothing. The means for attachment 20 is secured to the first end 12. This means for attachment 20 is shown in FIG. 2.

Figure 1:
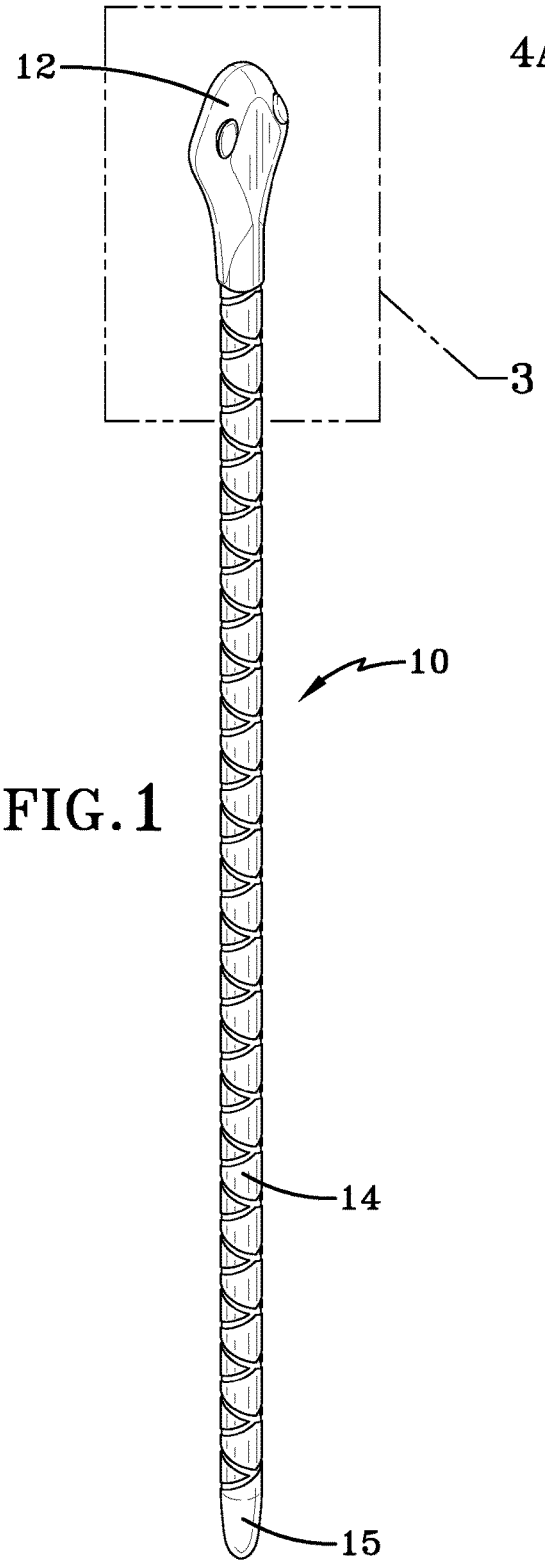
FIG. 1 is a frontal side perspective view of a first embodiment of the present invention.
Figure 2:
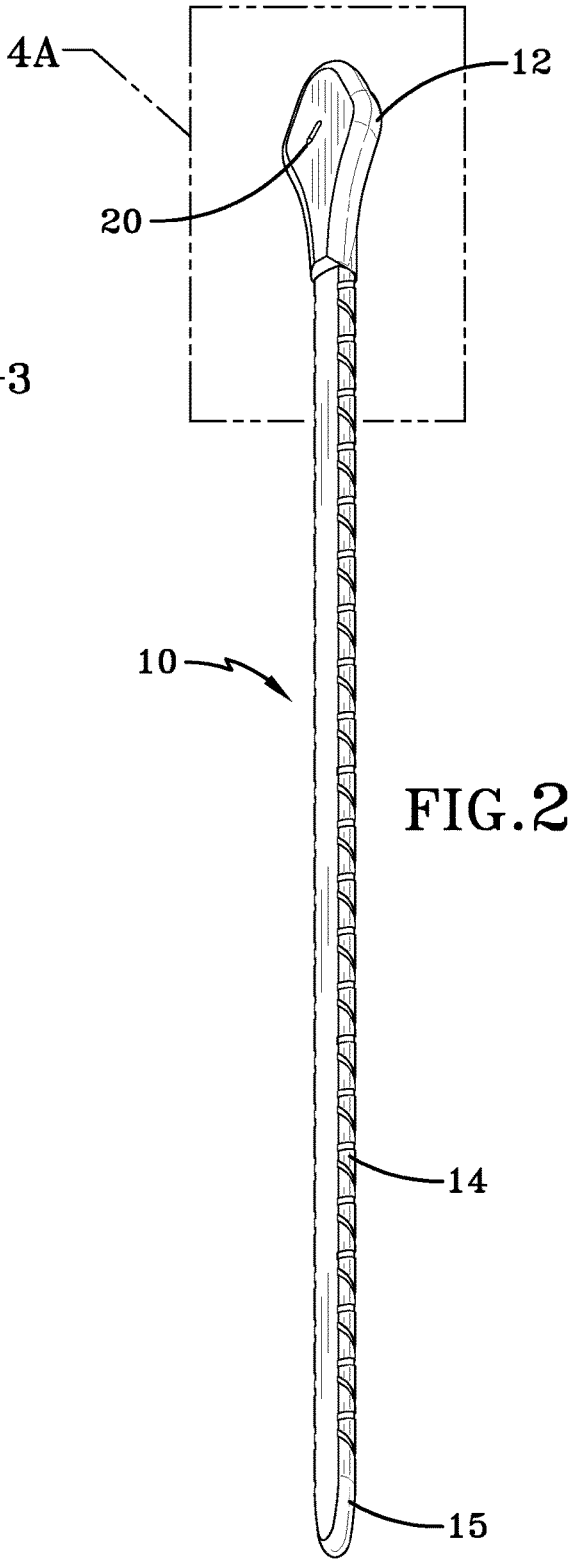
FIG. 2 is a rearward side perspective view of the first embodiment of FIG. 1.
Figure 3:
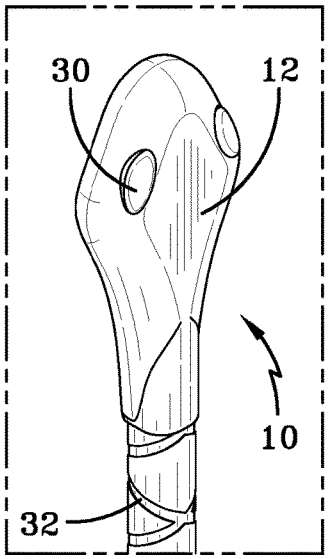
FIG. 3 is an enlarged view of an upper frontal portion of the first embodiment of FIG. 1.

In the first embodiment represented in FIGS. 1, 2, 3 and 3, the first embodiment depicts the design features of a reptile, more particularly a snake. As shown in FIG. 3, the snake at first end 12 has eyes 30. The eyes 30 can be inset or physically attached glass jewel components or jewels themselves. Along the body 14, 14A, 14B as illustrated in FIG. 3 is shown some markings that depict exemplary features of the snake's body profile. The design can be altered to the shape or markings of any snake representation desired and can be diamonds, stripes or other configurations, if so desired. As shown, the stripes 32 are merely exemplary.

Figure 4A:
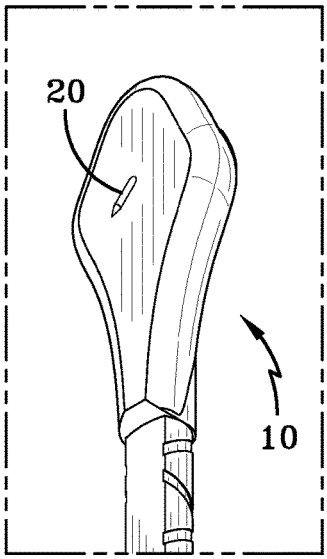
FIG. 4A is an enlarged view of an upper rearward portion of the first embodiment taken from FIG. 2 showing a single inclined attachment pin.
Figure 4B:
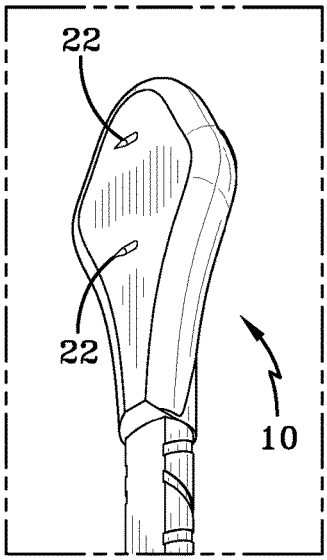
FIG. 4B is a similar view as FIG. 4A showing an alternative attachment feature of two inclined attachment pins.
Figure 4C:
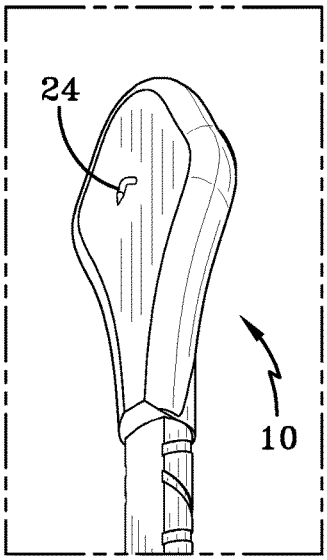
FIG. 4C is another view showing a bent single attachment pin.
Figure 4D:
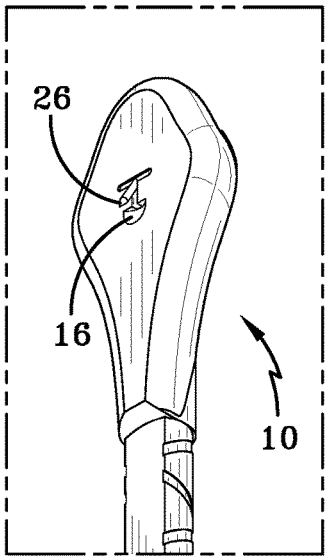
FIG. 4D is another alternative showing the inclined attachment pin pivotably hinged to the first embodiment as a fourth attachment feature.

With reference to FIGS. 4A-4D, the attachment means 20 is illustrated. In the first example, the attachment means 20 is a single pin 20. In FIG. 4B, two pins 22 are shown inclined relative to the bottom surface of the first end 12. In FIG. 4C, a bent or curved pin 24 is shown with a bent pointed end formed as a hook which will be described later as a form of attachment to the article of clothing. In FIG. 4D, a pivotable pin 26 is shown hinged to the first end 12 and there is a recessed cavity 16 to receive the hinged pin 26. In this embodiment, the pin 26 can extend outwardly basically on the same inclination as the other straight pins, however, it is to be appreciated that this inclination is approximately 45 degrees or less, preferably about 30 degrees.

Figure 5:
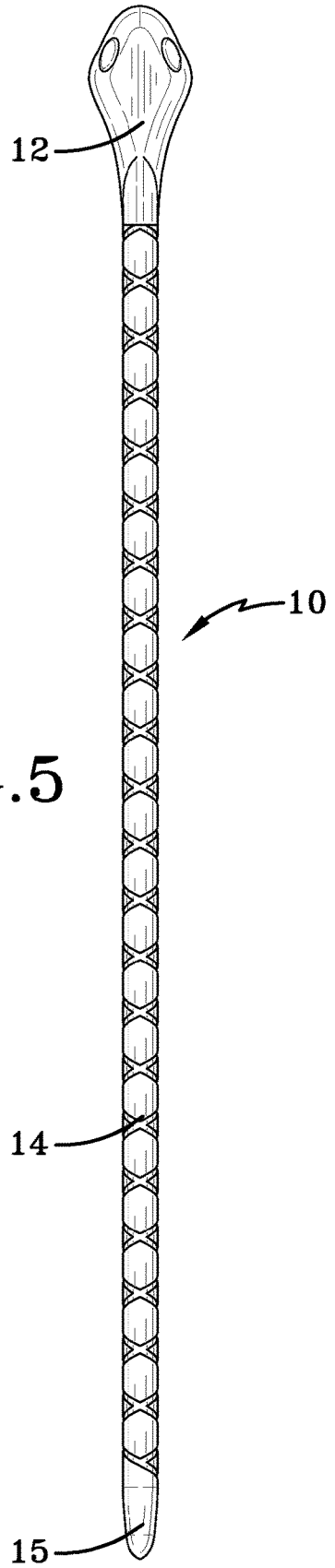
FIG. 5 is a plan frontal view.

FIG. 5 shows a plan frontal view of the elongated bendable jewelry device 10 in the form of the snake. As shown, the first end 12 has the bendable body 14 extending from the first end 12 to the second end 15.

Figure 6:
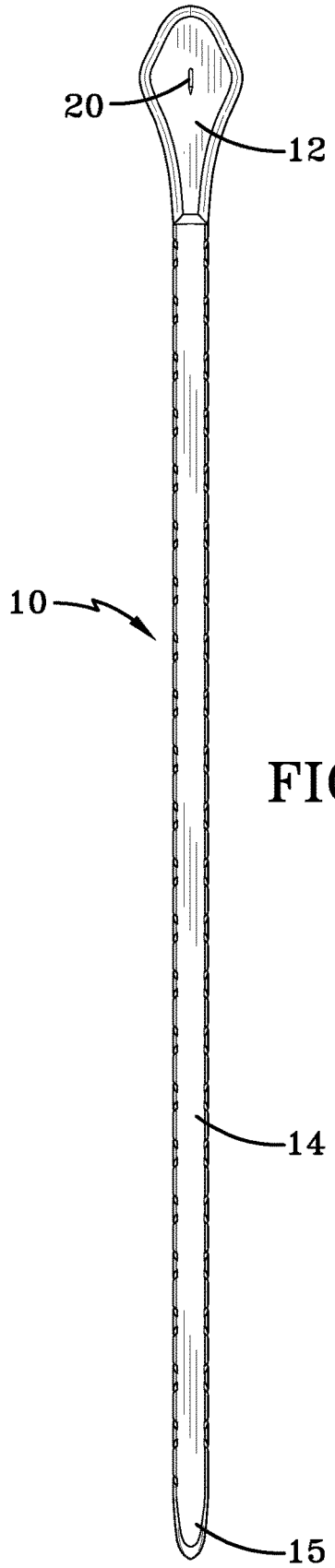
FIG. 6 is a plan rear view.

With reference to FIG. 6, the underside of the device 10 depicted as a snake is illustrated showing the attachment means 20 and the entire length of the device 10.

Figure 7:
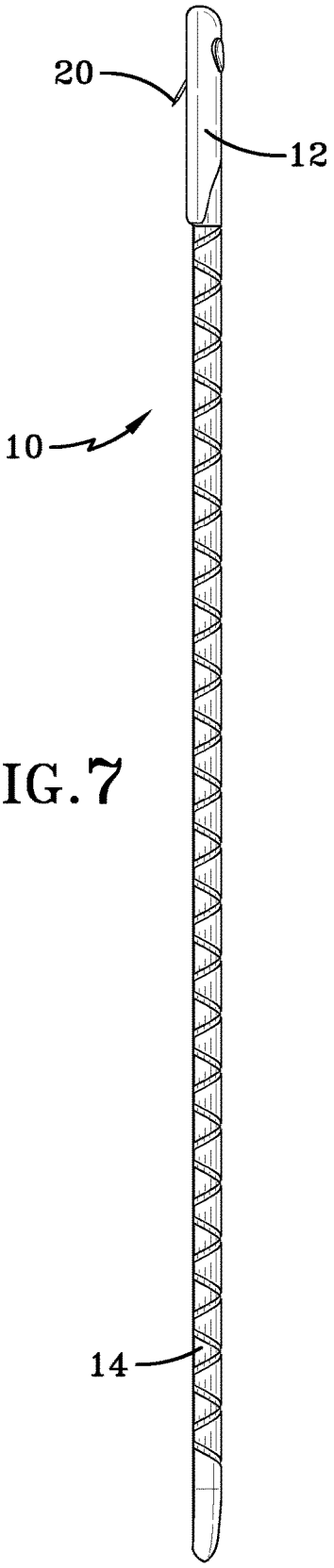
FIG. 7 is a plan side view.
Figure 8:
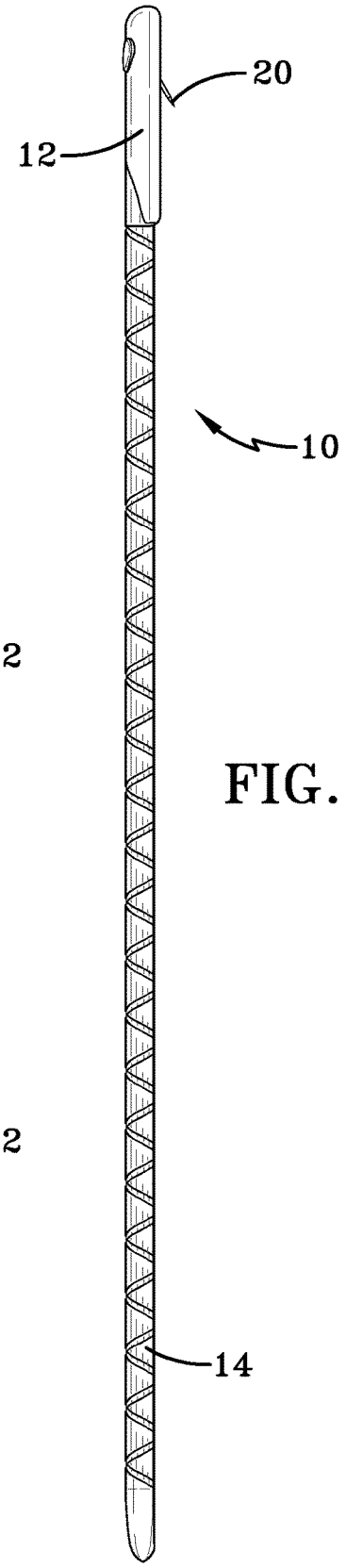
FIG. 8 is plan opposite side view.

With reference to FIGS. 7 and 8, both side views of the device 10 is illustrated.

Figure 9:
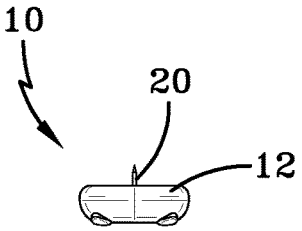
FIG. 9 is a frontal end view.

FIG. 9 shows a frontal end view of the device 10.

Figure 10:
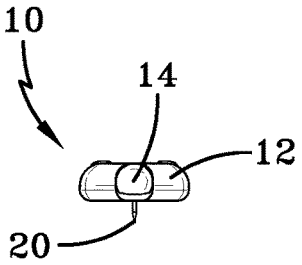
FIG. 10 is a rear end view.

FIG. 10 shows a end view of the device 10.

Figure 11:
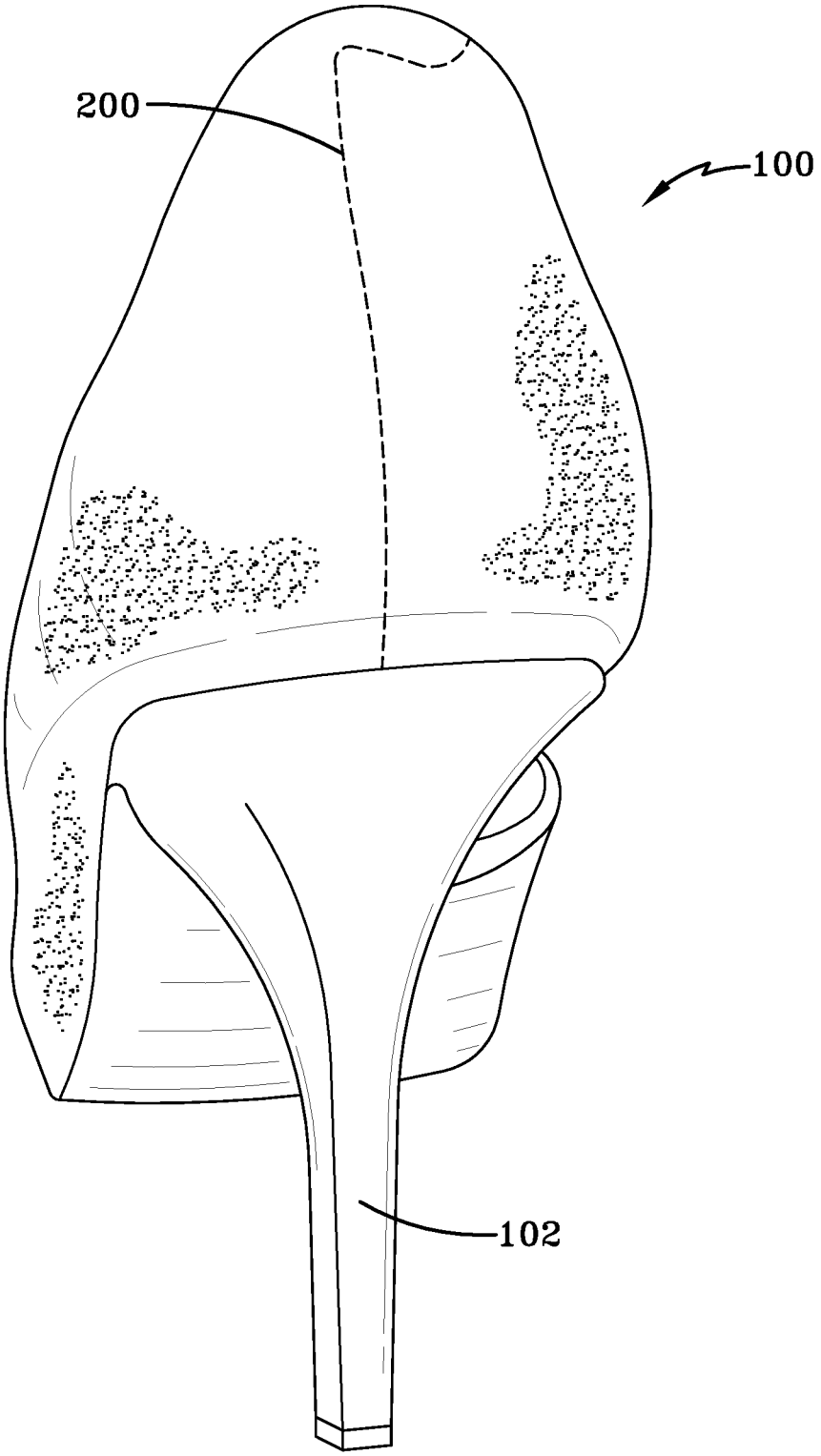
FIG. 11 is an exemplary shoe with a heel and the dashed line depicting a seam location.

With reference to FIG. 11, the article of clothing can be any article of clothing, however it is preferable that the article of clothing have a feature about which the device 10 can wrap or be bent coiling around such feature. A good example of this is shown in FIG. 11 wherein the article of clothing is a shoe 100, the shoe 100 has an elongated or high heel 102 and a stitched seam 200 towards the rear of the shoe 100.

Figure 12:
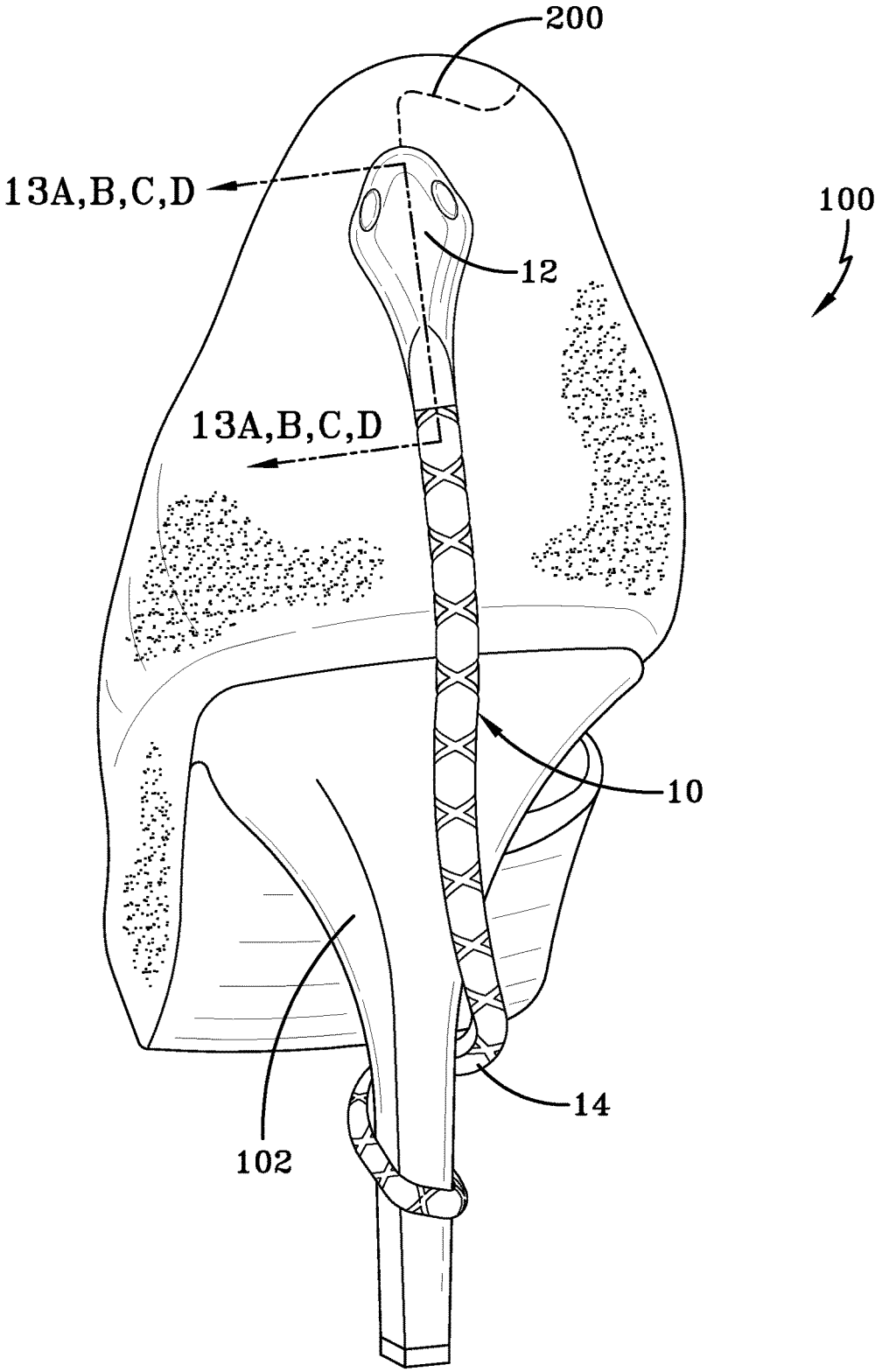
FIG. 12 is a view showing the shoe of FIG. 11 with the first embodiment device attached.
Figure 13A:
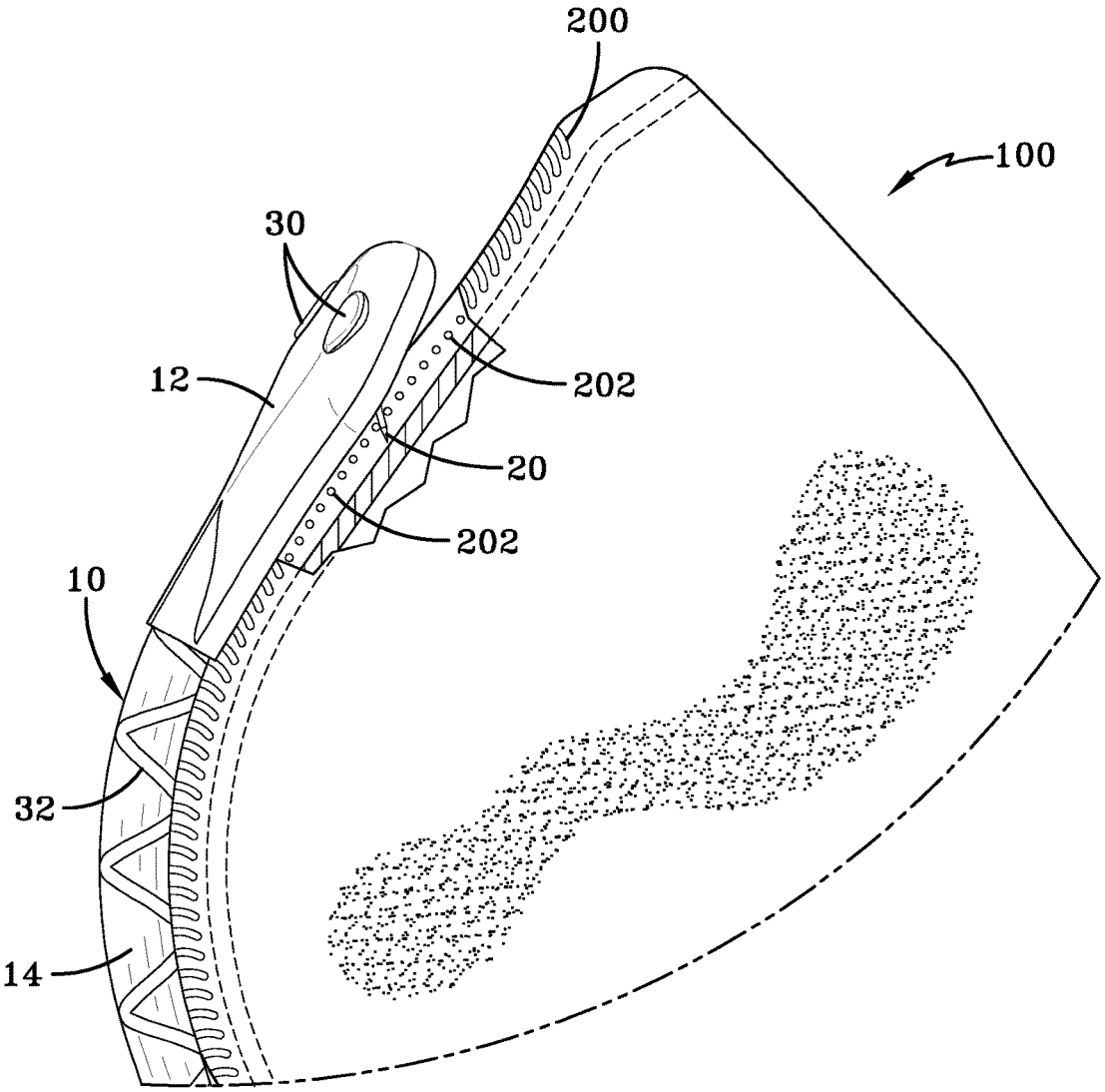
FIG. 13A is a view taken along lines 13A-13A of FIG. 12.
Figure 13B:
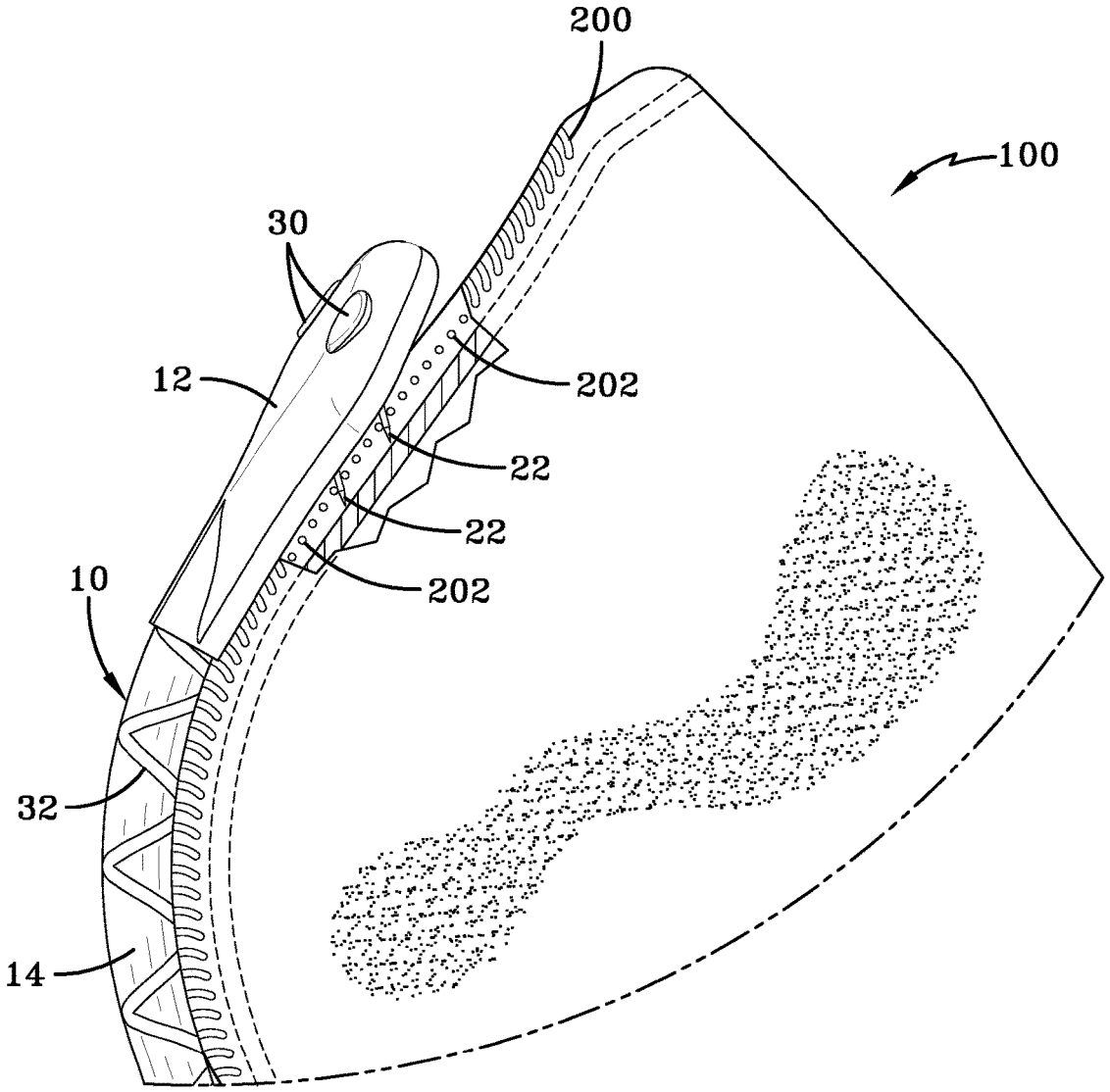
FIG. 13B is a view taken along lines 13B-13B of FIG. 12.
Figure 13C:
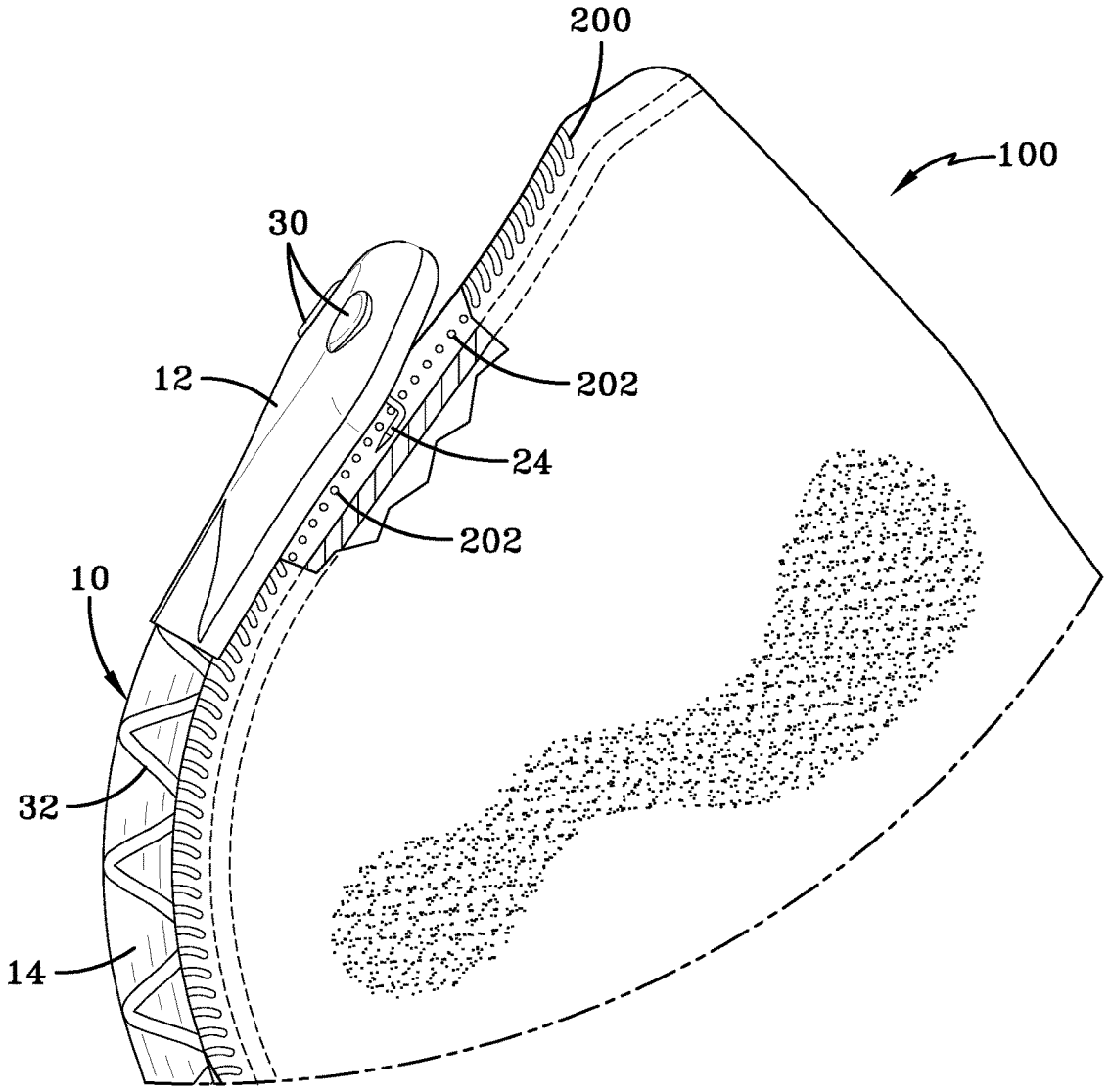
FIG. 13C is a view taken along lines 13C-13C of FIG. 12.
Figure 13D:
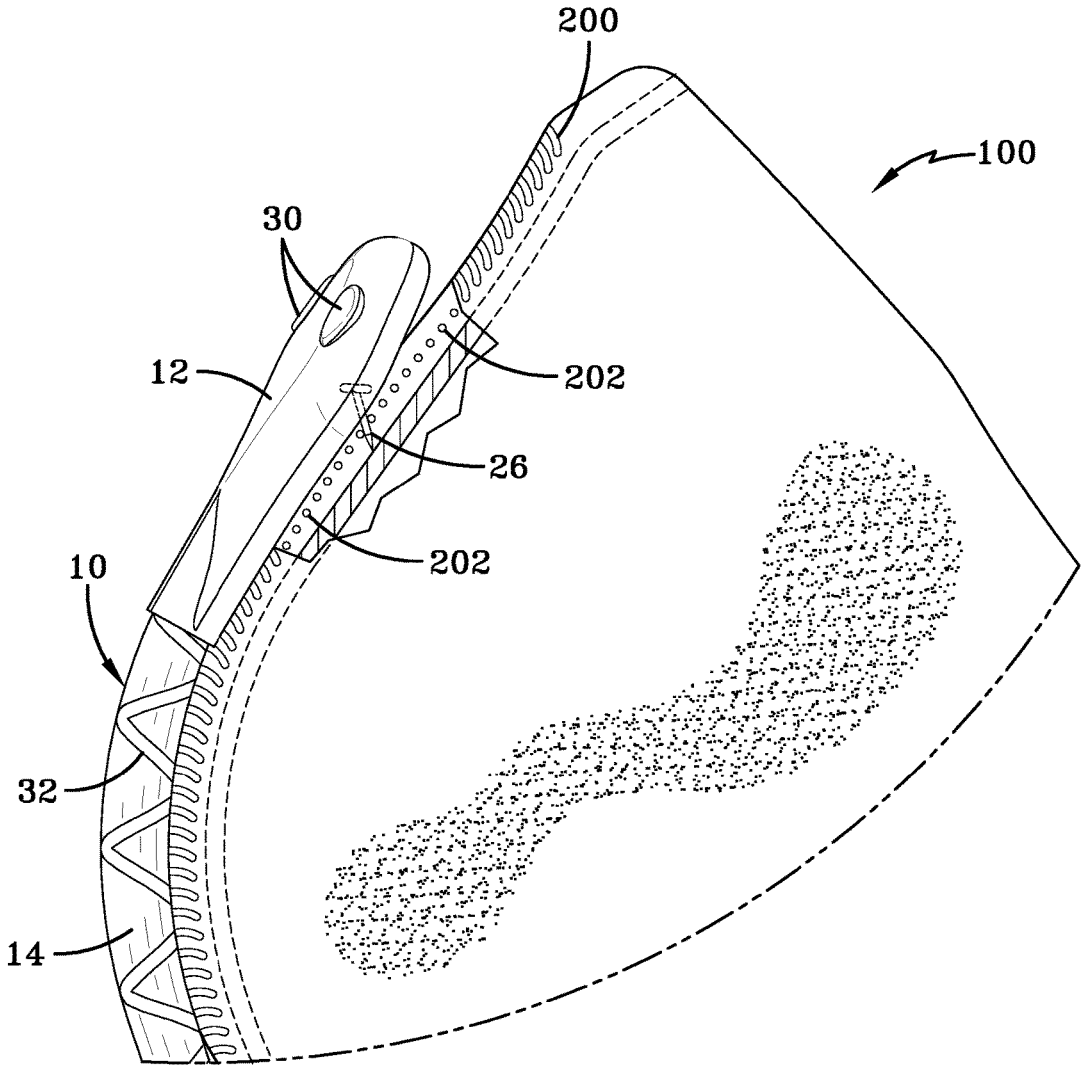
FIG. 13D is a view taken along lines 13D-13D of FIG. 12.

In FIG. 12, the device 10 is shown attached to the seam 200 at the first end 12 and extending downward towards the heel 102 where the body 14 is wrapped and coiled about a lower portion of the heel 102.

To better illustrate this, FIGS. 13A, 13B, 13C and 13D show how the attachment means 20 of the various pin components 20, 22, 24 and 26 can be attached through the threads 202 of the seam 200 in such a way that the attachment pins 20, 22, 24, 26 penetrate into and behind the seam 200. When this occurs, the first end 12 is fixed to the rear portion of the shoe 100 at the seam 200. This can be accomplished without ever penetrating the leather or material or the inner liner of the shoe 100 as illustrated. The body 14 then conforms in a bendable portion about the rear portion of the shoe 100 as illustrated in each of the embodiments and thereafter wraps about the heel 102 as shown in FIG. 12.

With reference to FIGS. 14A, 14B and 14C, a second embodiment 10A of the invention is shown. In this embodiment, all the elements of the first embodiment are shown, however, a capital letter A is added after each reference numeral. So the first end 12A has the attachment means affixed thereto and in that embodiment, two elongated bodies 14A are extending from the first end 12A, as illustrated. When attached to the shoe 100 at the seam location, as shown, the bow formed at the first end 12A and the elongated ribbons of the bow extend and wrap about the heel as shown in FIG. 14C.

Another alternative embodiment is illustrated in FIGS. 15A, 15B and 15C wherein the jewelry device 10B is shown as a zipper. In this embodiment, the zipper has a first end 12B with the attachment means illustrated at the first end 12B and the zipper has zipper teeth shown in a closed configuration. The end of the zipper is depicted as the opening means 18 of the zipper with a tongue 19 attached. In this fashion as shown in FIG. 15C, the shoe 100 can have the zipper attached at the seam 200 and extend and wrap about the heel as illustrated with the opening means 18 at the bottom of the heel 102 showing the zipper has been coiled about the shoe.

Figure 16:
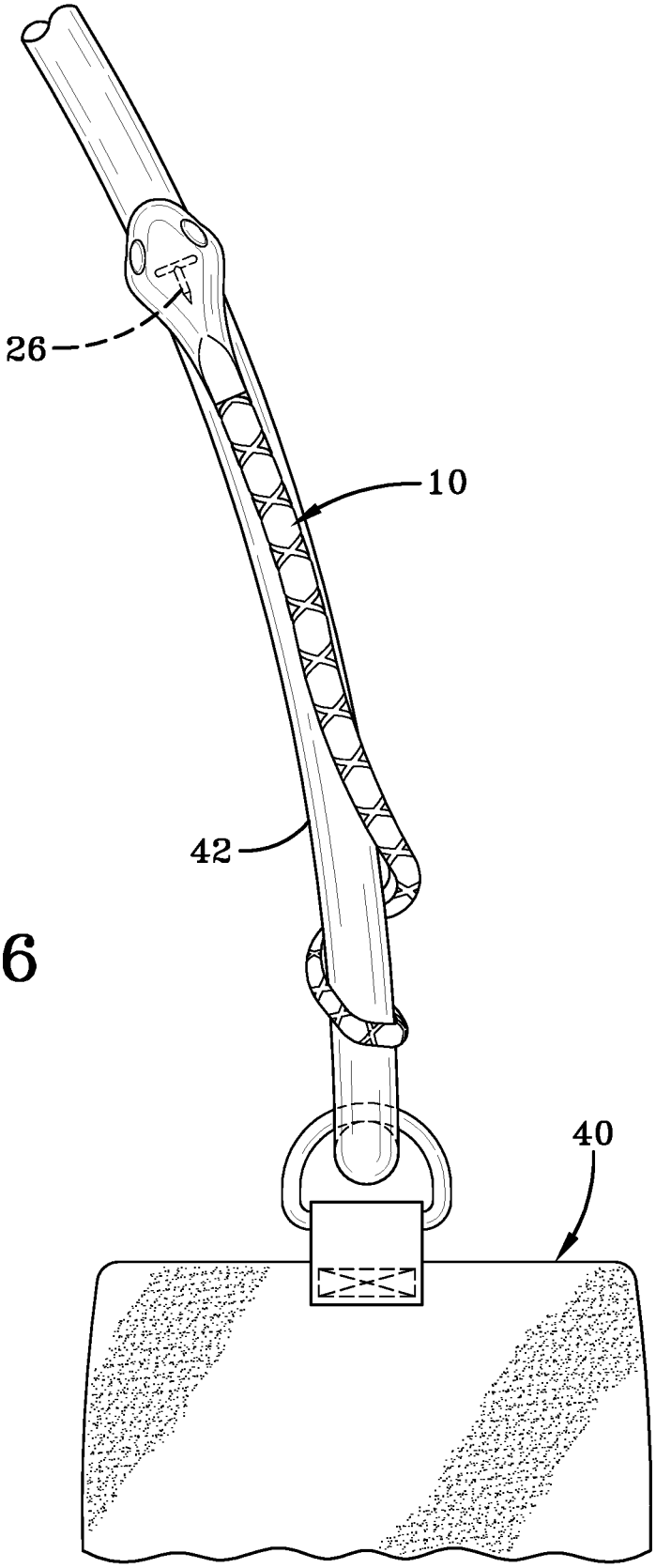
FIG. 16 is a partial view of a strap of a garment or a purse or other accessory showing the present invention attached and wrapped about the strap.

With reference to FIG. 16, a partial view is shown of a strap 42 of a garment or a purse or other accessory 40 showing the device 10 of the present invention attached and wrapped about the strap 42. When used on a garment or strap, the attachment means 20 may not need to penetrate a seam for attachment, therefore the pin 20, 22, 24, 26 could be eliminated or left folded down.

As indicated, these exemplary embodiments are only representative of the different types of design shapes that can be employed with the features of the present embodiment. As illustrated, the article of clothing is shown as a shoe, however, any elongated component can be used, such as a strap on a dress or a purse wherein the bendable device can be wrapped about the strap and attached at the first end to the strap using the attachment means as illustrated on the shoe.

To manufacture the bendable jewelry, it is preferable that the elongated structure be made of a bendable material that can retain its shape after being bent. The bendable material can be a soft metal alloy, a moldable plastic, or a moldable plastic with a wire reinforcement to retain the bent shape as desired. The bendable jewelry can be designed with an elongated structure in the form of a reptile, preferably a snake as shown in the first embodiment or a zipper as in the third embodiment or a bow as in the second embodiment. In any event, the device can be wrapped about the heel of the shoe without damaging the shoe or can alternatively be attached to an article of clothing such as a strap or other component of a dress or a purse allowing the jewelry to fit comfortably without damaging the article. As shown the device can be molded with the desired textured surface replicating a snake or other reptile or any other feature or could be painted molded with a particular color. In addition, the jewelry can be plated with gold plating or could be made out of precious metal if so desired. The jewelry can then be enhanced with the addition of such features as eyes that are made of jewels as shown these jewels can be glass or they can be precious jewels. Accordingly, the device can be made either very inexpensively when made with plastic material embedded with a wire or a moldable rubber material embedded with a wire or very expensive with precious metals and jewels, depending on the taste of the consumer.

While shown as a snake, a bow or a zipper, it is also understood the device 10 could for example, be an alligator, a lizard, a dragon or any other elongated design. And these are particularly valuable when used resembling sports team's mascots.

Variations in the present invention are possible in light of the description of it provided herein. While certain representative embodiments and details have been shown for the purpose of illustrating the subject invention, it will be apparent to those skilled in this art that various changes and modifications can be made therein without departing from the scope of the subject invention. It is, therefore, to be understood that changes can be made in the particular embodiments described, which will be within the full intended scope of the invention as defined by the following appended claims.

What is claimed is:

1. A bendable jewelry device, the device comprising: an elongated structure, the elongated structure having a first end portion and one or two elongated bodies extending from the first end portion, at least one of the elongated bodies having a length extending from the first end portion toward an opposite end of the elongated structure, the one or two elongated bodies being bendable along the length to spirally wrap into a coil completely encircling a portion of an article of clothing, the article of clothing having a seam, wherein the first end portion has a bottom surface having one or two pins projecting from the bottom surface for attaching the first end portion to a portion of the article of clothing, the one or two pins configured to penetrate into the seam wherein the one or two pins are each secured to the first end portion extending directionally toward the one or two elongated bodies on an inclined angle of less than 45 degrees relative to the bottom surface of the first end portion from which the pin or pins project from and the coiled end of the one or two elongated bodies fixes the pin or pins in place in the seam.

2. The bendable jewelry device of claim 1 wherein the inclined angle is about 30 degrees.

3. The bendable jewelry device of claim 1 wherein the one or two pins is a bent form with a hooked end having the end directionally extending toward a portion of the elongated body.

4. The bendable jewelry device of claim 1 wherein the one or two pins are hinged pins.

5. The bendable jewelry device of claim 4 wherein each hinged pin is configured to fold and the first end has a recessed cavity to receive the hinged pin.

6. The bendable jewelry device of claim 1 wherein the elongated structure is made of a bendable material that retains the bent shape after bending.

7. The bendable jewelry device of claim 6 wherein the bendable material is selected from the group consisting of a soft metal alloy, a moldable plastic or moldable plastic with wire reinforcement to retain bended shapes.

8. The bendable jewelry device of claim 1 wherein the elongated structure is in the form of a reptile.

9. The bendable jewelry device of claim 8 wherein the reptile is a snake with a head at the first end and tail at the second end.

10. The bendable jewelry device of claim 1 wherein the elongated structure is in the form of a zipper.

11. The bendable jewelry device of claim 1 wherein the elongated structure is in the form of a bow having two elongated ribbons extending to form the two elongated bodies.

12. A bendable jewelry device, the device comprising:

an elongated structure, the elongated structure having a first end portion and one or two elongated bodies extending from the first end portion, at least one of the elongated bodies having a length extending from the first end portion toward an opposite end of the elongated structure, the one or two elongated bodies being bendable along the length to spirally wrap into a coil completely encircling a portion of an article of clothing, the article of clothing having a seam, wherein the first end portion has a bottom surface having one or two pins projecting from the bottom surface for attaching the first end portion to a portion of the article of clothing, the one or two pins configured to penetrate into the seam wherein the one or two pins are each secured to the first end portion extending directionally toward the one or two elongated bodies on an inclined angle of less than 45 degrees relative to the bottom surface of the first end portion from which the one or two pins project from and the coiled end of the one or two elongated bodies fixes the one or two pins in place in the seam wherein the article of clothing is a shoe and the one or two pins are configured to penetrate into a stitched seam of the shoe and stitches of the shoe seam hold the first end portion, and wherein the first end portion when held at the seam is fixed in place by a bending of the elongated bodies at or adjacent the opposite end of the elongated structure, the one or two elongated bodies being wrapped and coiled about a portion of a heel of the shoe spaced from the first end.

13. The bendable jewelry device of claim 12 wherein at least one of the elongated bodies wraps spirally about the heel forming at least one coil.

* * * * *